US005862986A

United States Patent [19]

Bolyard, Jr. et al.

[11] Patent Number: 5,862,986

[45] Date of Patent: Jan. 26, 1999

[54] HOT MELT ADHESIVE APPLICATOR WITH METERING GEAR-DRIVEN HEAD

[75] Inventors: Edward W. Bolyard, Jr., Old Hickory; Leonard E. Riggan, Jr., Nashville, both of Tenn.

[73] Assignee: Illinois Tool Works, Inc., Glenview, Ill.

[21] Appl. No.: 683,064

[22] Filed: Jul. 16, 1996

[51] Int. Cl.[6] ..... B05B 1/24

[52] U.S. Cl. ..... 239/135; 239/124; 239/128; 239/126; 239/290; 137/115.13

[58] Field of Search ..... 239/128, 135, 239/124, 125, 126, 127, 290, 533.15; 137/115.13, 118.01

[56] References Cited

U.S. PATENT DOCUMENTS

| | | | |
|---|---|---|---|
| 3,348,520 | 10/1967 | Lockwood | 239/533.15 X |
| 4,227,069 | 10/1980 | Gardner et al. | 239/135 X |
| 4,308,431 | 12/1981 | Hanbicki | 179/111 R |
| 4,687,137 | 8/1987 | Boger et al. | 239/124 |
| 4,735,362 | 4/1988 | Trautwein et al. | 239/127 |
| 4,983,109 | 1/1991 | Miller et al. | 239/125 X |
| 5,000,112 | 3/1991 | Rothen et al. . | |
| 5,257,723 | 11/1993 | Bagung . | |
| 5,407,291 | 4/1995 | Messerly et al. | 239/124 |
| 5,458,291 | 10/1995 | Brusko et al. | 239/423 |
| 5,532,074 | 7/1996 | Golben | 429/53 |
| 5,620,139 | 4/1997 | Ziecker | 239/124 |

FOREIGN PATENT DOCUMENTS

| | | |
|---|---|---|
| 0111850 | 5/1984 | European Pat. Off. . |
| 0324170 | 7/1989 | European Pat. Off. . |
| WO9521703 | 8/1995 | WIPO . |

*Primary Examiner*—Andres Kashnikow
*Assistant Examiner*—Robin O. Evans
*Attorney, Agent, or Firm*—Donald J. Breh

[57] ABSTRACT

A system usable for dispensing fluids including hot melt adhesives, supplied from a reservoir, onto a substrate. The system includes a plurality of fluid dispensing nozzles coupled to a fluid supply conduits disposed in a main manifold wherein fluid is supplied from a fluid metering device. An air preheater module is mountable to the nozzles and provides heated air for controlling the fluid dispensed by the nozzles. The main manifold includes a plurality of recirculation conduits each disposed between a fluid supply conduit and the fluid reservoir. A one-way valve disposed along each recirculation conduit conditionally recirculates fluid toward the fluid reservoir. A variety of recirculation manifold configurations are interchangeably mounted to the main manifold for recirculating fluid toward the fluid reservoir. Fluid pressure gauges monitor pressure in individual fluid supply conduits, or alternatively an average fluid pressure. The fluid metering device is mountable in a well in the main manifold, wherein a common heating member heats both the main manifold and the fluid metering device.

28 Claims, 6 Drawing Sheets

HOT MELT ADHESIVE APPLICATOR WITH METERING GEAR-DRIVEN HEAD

BACKGROUND OF THE INVENTION

The invention relates generally to a system for dispensing fluids onto a substrate, and more particularly to a system having a manifold coupled to an array of adhesive dispensing nozzles for precisely dispensing hot melt adhesives supplied from a reservoir to the manifold by a metering gear pump.

The precise dispensing of hot melt adhesives and other fluids onto substrates is required in many applications. The manufacture of a variety of bodily fluid absorbing hygienic articles including disposable diapers and incontinence pads, sanitary napkins, patient underlays, and surgical dressings, for example, often requires bonding one or more layers of material, or substrates. These layers of material include, more specifically, a fluid impermeable, highly flexible thin film such as polypropylene or polyethylene onto which is adhered a highly absorbent pad often formed of a cellulose or plastic material covered by a non-woven fleece-like material. The fluid impermeable thin film, however, is extremely temperature sensitive, and hot melt adhesives have a tendency to deform the film and in some cases melt through the film. Materials bonded in other applications are similarly temperature sensitive.

It is known to dispense hot melt adhesive onto a substrate from nozzles that form thin fibers or stands of adhesive, which are nearly invisible to the naked eye and incapable of melting or distorting the substrate. In many applications, a plurality of adhesive dispensing nozzles are arranged generally in an elongated array directed toward the substrate, which is usually moved transversely relative to the nozzles. The hot melt adhesive is very often supplied to the nozzles from a reservoir by a gear pump including several fluid outlets, which simultaneously supply precisely metered amounts of adhesive to several corresponding fluid dispensing nozzles. U.S. Pat. No. 4,983,109 to Miller et al., for example, discusses several gear pumps interconnected by a common manifold assembly, including a pump manifold and a distribution manifold, to a plurality of nozzles wherein each gear pump simultaneously supplies precise amounts of adhesive to several corresponding nozzles. Each nozzle is specially configured for coupling with a corresponding adhesive supply conduit alone or in combination with a corresponding air supply conduit. A blocking plate configuration permits blocking alternatively the nozzle to prevent adhesive dispensing wherein the blocking plate recirculates adhesive back to the adhesive reservoir or back to the gear pump.

The inventors of the present invention recognize that controlling the temperature of compressed air combined with the hot adhesive in the nozzle is an effective means for controlling the adhesive dispensed by the nozzle. U.S. Pat. No. 4,983,109 to Miller et al., however, is not capable of independently controlling air temperature since compressed air is supplied through the common manifold assembly, which is maintained at a temperature required for adequately supplying and properly dispensing adhesive. The inventors of the present invention also recognize that it is desirable to recirculate adhesive as a means for dynamic pressure regulation, which may be required in the event adhesive flow through the one or more nozzles becomes obstructed, which occasionally occurs over time. Prior art hot melt adhesive applicators generally regulate pressure by limiting current to the motor that drives the gear pump, or by a clutch assembly that slips to limit load on the motor resulting from excessive fluid pressure. In U.S. Pat. No. 4,983,109 to Miller et al., adhesive is recirculated only when the nozzle is replaced by the specially configured blocking plate, which includes an internal passage interconnecting the adhesive supply conduit and the recirculation conduit. The blocking plate is however not intended to dispense adhesive or to regulate pressure in the event that an operational nozzle becomes obstructed.

In view of the discussion above, there exists a demonstrated need for an advancement in the art of fluid dispensing systems.

It is therefore an object of the invention to provide a novel system for dispensing fluids which overcomes problems in the prior art.

It is another object of the invention to provide a novel system for dispensing hot melt adhesives through a plurality of nozzles coupled to a manifold wherein hot melt adhesive is supplied to the nozzles, from a reservoir, by a common metering gear pump coupled to the manifold, which forms a metering gear-driven head.

It is also an object of the invention to provide a novel system usable for dispensing hot melt adhesives wherein the system includes adhesive dispensing nozzles for modifying dispensed adhesive with compressed air at a temperature controllable independently from an adhesive temperature.

It is another object of the invention to provide a novel system usable for dispensing hot melt adhesives including a plurality of adhesive dispensing nozzles coupled to a main manifold wherein fluid pressure is regulatable by recirculating adhesive toward the reservoir or toward the metering gear pump.

It is a further object of the invention to provide a novel system usable for supplying hot melt adhesives from a reservoir by a metering gear pump, dispensing hot melt adhesives through a plurality of adhesive dispensing nozzles coupled to a main manifold, and regulating fluid pressure by recirculating adhesive toward the reservoir through a recirculation manifold interchangeably coupled to the main manifold.

It is a further object of the invention to provide a novel system usable for dispensing hot melt adhesives, supplied from a reservoir by a metering gear pump, wherein the system includes a metering gear-driven head having a main manifold with a well for receiving the metering gear pump, and a common heating member for heating the main manifold and the metering gear pump.

It is still another object of the invention to provide a novel system usable for dispensing hot melt adhesives wherein the system includes a plurality of adjacently mounted main manifolds coupled to a plurality of fluid dispensing nozzles separated by substantially equal spacing therebetween and arranged along the plurality of adjacently mounted main manifolds.

It is a yet another object of the invention to provide a novel system usable for dispensing hot melt adhesives wherein the system includes a plurality of adjacently mounted main manifolds each having a second fluid supply conduit coupleable to a second fluid supply conduit of an adjacent main manifold.

These and other objects, features and advantages of the present invention will become more fully apparent upon consideration of the following Detailed Description of the Invention with the accompanying drawings, which may be disproportionate for ease of understanding, wherein like structure and steps are referenced by corresponding numerals and indicators.

DETAILED DESCRIPTION OF THE INVENTION

Figure 1:
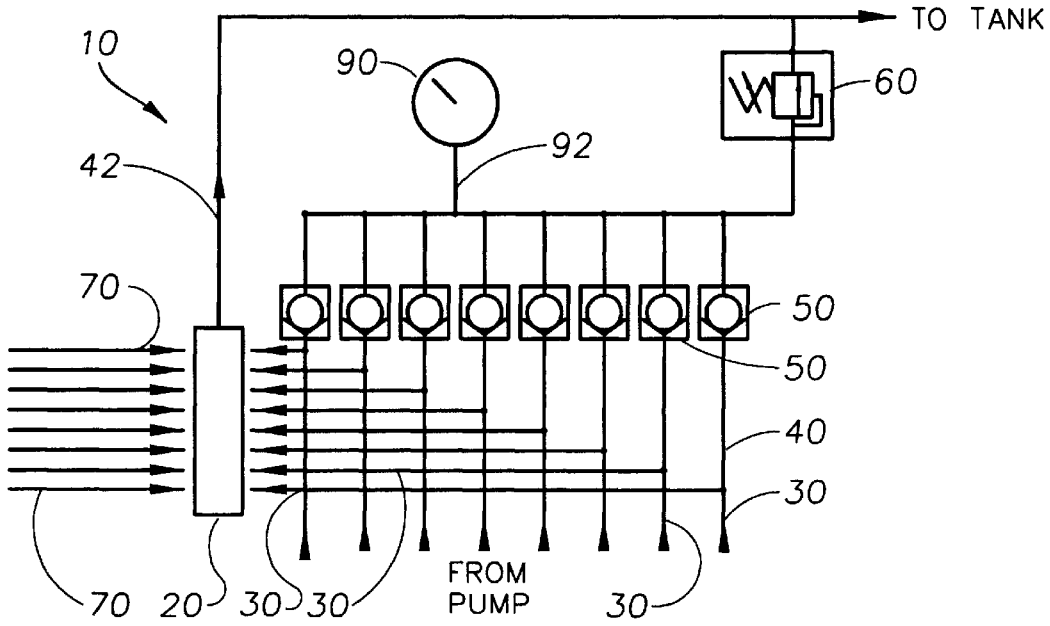
FIG. 1 is a fluid flow schematic for a fluid dispensing system according to an exemplary embodiment of the invention.

The present invention is suitable generally for dispensing fluids onto a substrate in a variety of applications, including applications where precise dispensing of fluid onto the substrate is required, and the invention is suitable particularly for precisely dispensing hot melt adhesives of the type used for bonding layered materials in the manufacture of hygienic articles.

According to the invention as illustrated in the exemplary fluid flow schematics of FIGS. 1 through 4, the fluid dispensing system 10 comprises generally a plurality of nozzles 20 interconnectable to a fluid reservoir, or tank, by a plurality of fluid supply conduits 30 and one or more fluid metering devices, or pumps, which independently supply fluid from the tank to each of the plurality of nozzles 20 through a corresponding fluid supply conduit 30. In another configuration, the system 10 includes a plurality of recirculation conduits 40 each interconnectable between a corresponding fluid supply conduit 30 and the tank by a plurality of one-way valves each disposed along a corresponding recirculation conduit 40. The one-way valves conditionally recirculate fluid from the corresponding fluid supply conduit 30 toward the tank, wherein fluid is recirculatable either back to the tank or back to the pump. The one-way valves are generally configured to recirculate fluid when pressure in the fluid supply conduit 30 exceeds a predetermined fluid pressure threshold. The oneway valves, moreover, independently regulate pressure between the pump or pumps and the corresponding nozzles 20 without affecting the pressure in the remaining nozzles.

Figure 2:
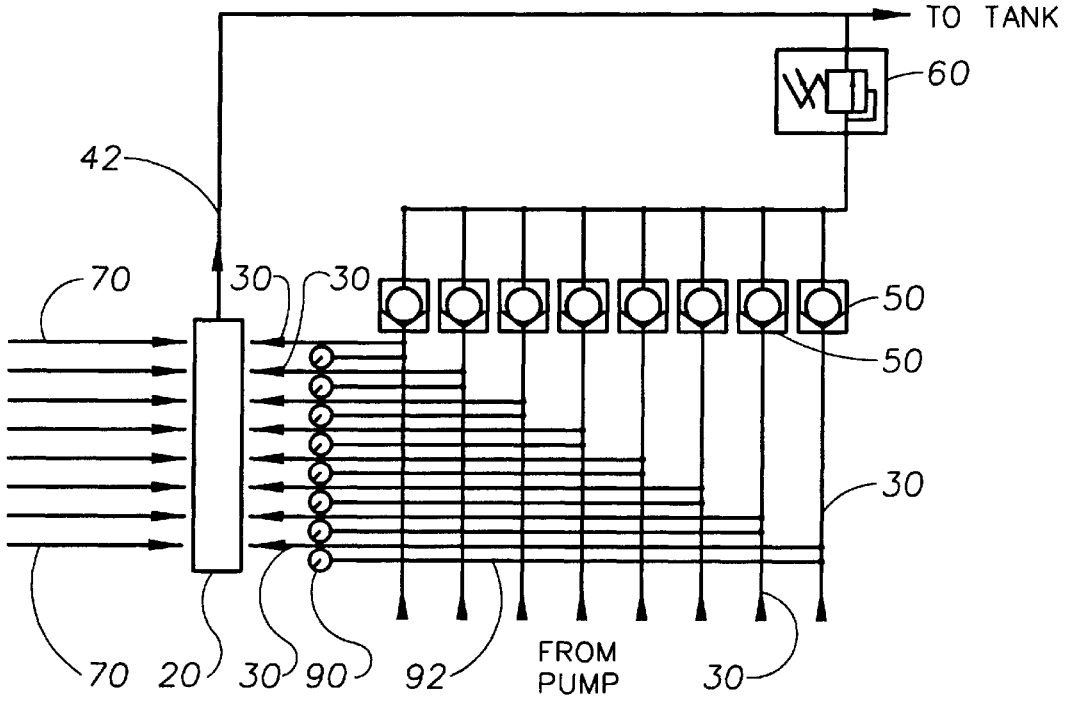
FIG. 2 is a fluid flow schematic for a fluid dispensing system according to a first alternative embodiment of the invention.
Figure 4:
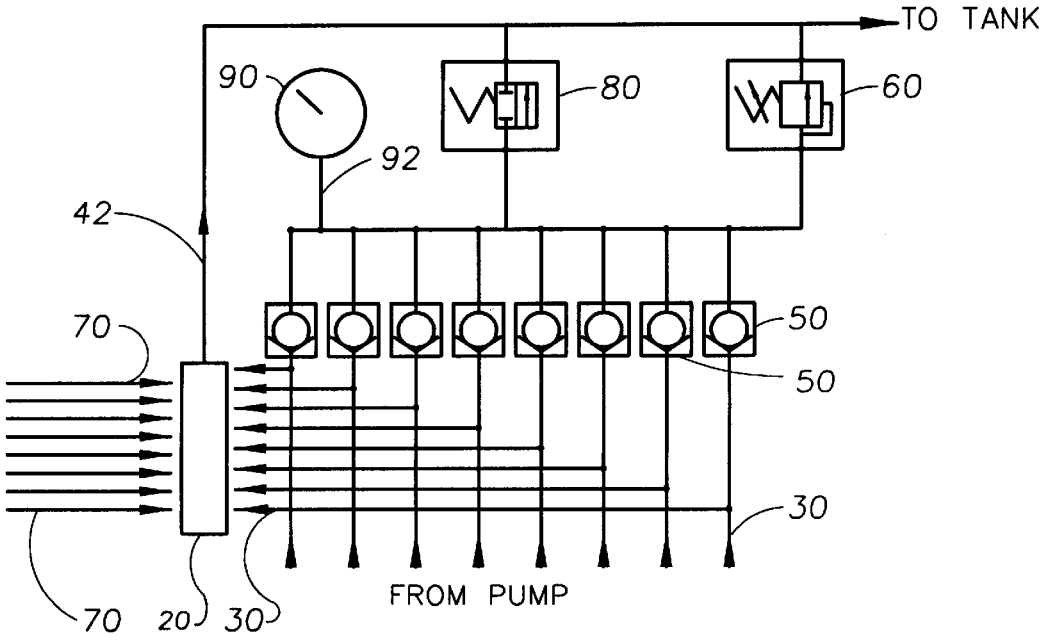
FIG. 4 is a fluid flow schematic for a fluid dispensing system according to a third alternative embodiment of the invention.

In the exemplary fluid flow schematics of FIGS. 1, 2 and 4, the one-way valve is a normally closed check valve 50. The system 10 also includes at least one normally closed one-way pressure relief valve 60 disposed between the plurality of one-way check valves 50 and the tank. The check valves 50 are independently operated one-way valves, and are opened to recirculate fluid toward the tank when pressure in the corresponding fluid supply conduit 30 exceeds a first threshold pressure. The pressure relief valve 60 is opened to recirculate fluid toward the tank when the pressure between the check valves 50 and the pressure relief valve 60 exceeds a second threshold pressure, which is greater than the first threshold pressure. The check valves 50 independently regulate pressure between the pump or pumps and the corresponding nozzles 20 without affecting the pressure in the remaining nozzles. In one application, the first threshold pressure of the check valves 50 is several psi greater than the desired fluid pressure in the fluid supply conduit 30, and the second threshold pressure of the pressure relief valve 60 is between approximately 2 and 3 times the desired fluid pressure in the fluid supply conduit 30. In the exemplary fluid flow schematics FIGS. 1, 2 and 4, a manually operated pressure discharge valve, not shown, may also be disposed between the plurality of check valves 50 and the pressure relief valve 60 for relieving fluid pressures below the second pressure threshold, which is useful for resetting the system. In another configuration, a plurality of air supply conduits 70 each are interconnectable between an air supply not shown and a corresponding nozzle 20 wherein the air supply conduits 70 supply compressed air to the nozzle usable for modifying a fluid pattern dispensed therefrom as further discussed below.

The exemplary fluid flow schematic of FIG. 4 includes a normally closed diverter valve 80 disposed between the plurality of one-way check valves 50 and the tank in parallel to the normally closed pressure relief valve 60. The diverter valve 80 relieves fluid pressure between the plurality of check valves 50 and the pressure relief valve 60 to reduce fluid pressure in the fluid supply conduits 30 when the pump is energized and the plurality of nozzles 20 are closed. The diverter valve 80 reduces the tendency for fluid to surge through the nozzles 20 when the nozzles are first opened. The diverter valve 80 is a particularly desirable feature for applications where the nozzles 20 are opened and closed intermittently. In operation, the normally closed diverter valve 80 is opened when the nozzles 20 are closed, and the diverter valve is closed when the nozzles are opened. The diverter valve 80 also eliminates any requirement for the manual pressure discharge valve discussed above.

Figure 3:
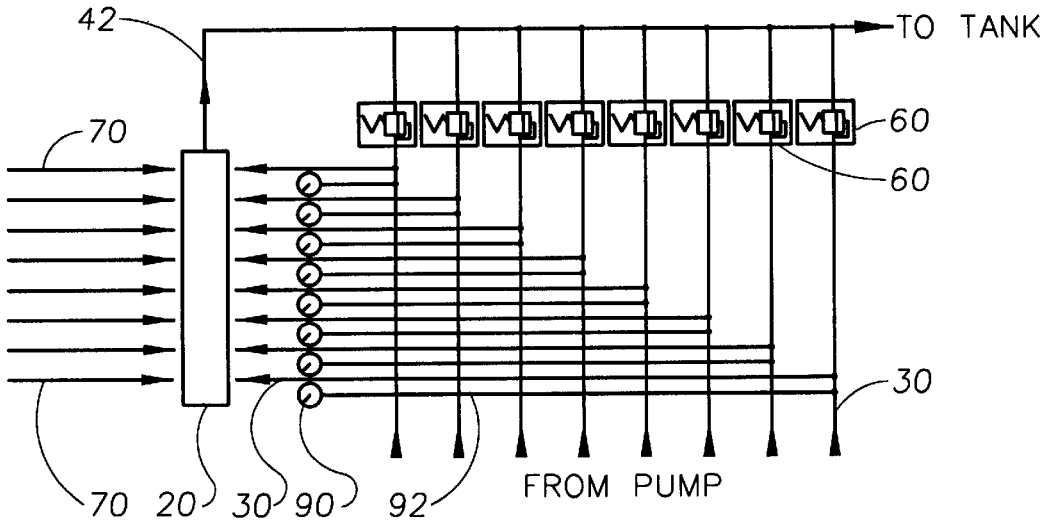
FIG. 3 is a fluid flow schematic for a fluid dispensing system according to a second alternative embodiment of the invention.

In the exemplary fluid flow schematic of FIG. 3, the plurality of one-way valves are a plurality of normally closed pressure relief valves 60, which are opened to recirculate fluid toward the tank when pressure in the corresponding fluid supply conduit 30 exceeds a threshold fluid pressure. The pressure relief valves 60 independently regulate pressure between the pump or pumps and the corresponding nozzles 20 without affecting the pressure in the remaining nozzles. In one embodiment, the threshold pressure is between approximately 2 and 3 times a desired fluid pressure in the fluid supply conduit 30 as discussed above. In an alternative configuration, a plurality of air supply conduits 70 each are interconnectable between an air supply not shown and corresponding nozzles 20 wherein the air supply conduits 70 supply compressed air to the nozzles for modifying a fluid pattern dispensed therefrom as further discussed below.

The exemplary fluid flow schematics of FIGS. 1 and 4 include a pressure monitoring gauge 90 and pressure monitoring port 92 connectable between the plurality of check valves 50 and the pressure relief valve 60 for monitoring an average fluid pressure therebetween, which results from pressure increases in any one or more of the plurality of fluid supply conduits 30. According to the alternative fluid flow schematics of FIGS. 2 and 3, a plurality of pressure monitoring gauges 90 and ports 92 are each connectable with a corresponding fluid supply conduit 30 for monitoring individually fluid pressure in a corresponding fluid supply conduit 30 between a corresponding nozzle 20 and pump.

According to another embodiment, the pressure monitoring gauges 90 are either replaced by or coupled to a pressure transducer connectable to an audio or visual alarm for indicating that one or more fluid supply conduits 30 is recirculating fluid, which often indicative of an obstructed nozzle 20. In the configurations of FIGS. 1 and 4, a single transducer and alarm coupled to the pressure port 92 indicates generally that one or more fluid supply conduits 30 are recirculating fluid, but the alarm does not specifically identify the fluid supply conduit 30 recirculating fluid. In the configurations of FIGS. 2 and 3, each fluid supply conduit 30 and nozzle 20 includes a corresponding transducer and alarm for identifying the specific fluid supply conduit or conduits 30 that are recirculating fluid.

In some applications it is desirable to intentionally block one or more fluid supply conduits 30 and recirculate fluid from the blocked fluid supply conduits 30 toward the reservoir without sounding an alarm or otherwise indicating that fluid is recirculating from the blocked fluid supply conduits 30. More specifically, one or more nozzles 20 may be intentionally turned off or replaced with a blocking plate that obstructs fluid flow from a fluid supply conduit 30. Under these circumstances fluid from the blocked fluid supply conduits 30 is generally recirculated to either the fluid pump or the fluid reservoir. Recirculating fluid through the recirculation conduit 40, however, precludes use of an alarm for indicating unintentional fluid recirculation, which may occur as a result of an obstructed nozzle. According to an alternative embodiment, recirculation conduit 42, coupled to either one or more closed nozzles 20 or fluid supply conduit blocking plates, recirculates fluid from the corresponding fluid supply conduits 30 toward the reservoir.

Figure 5:
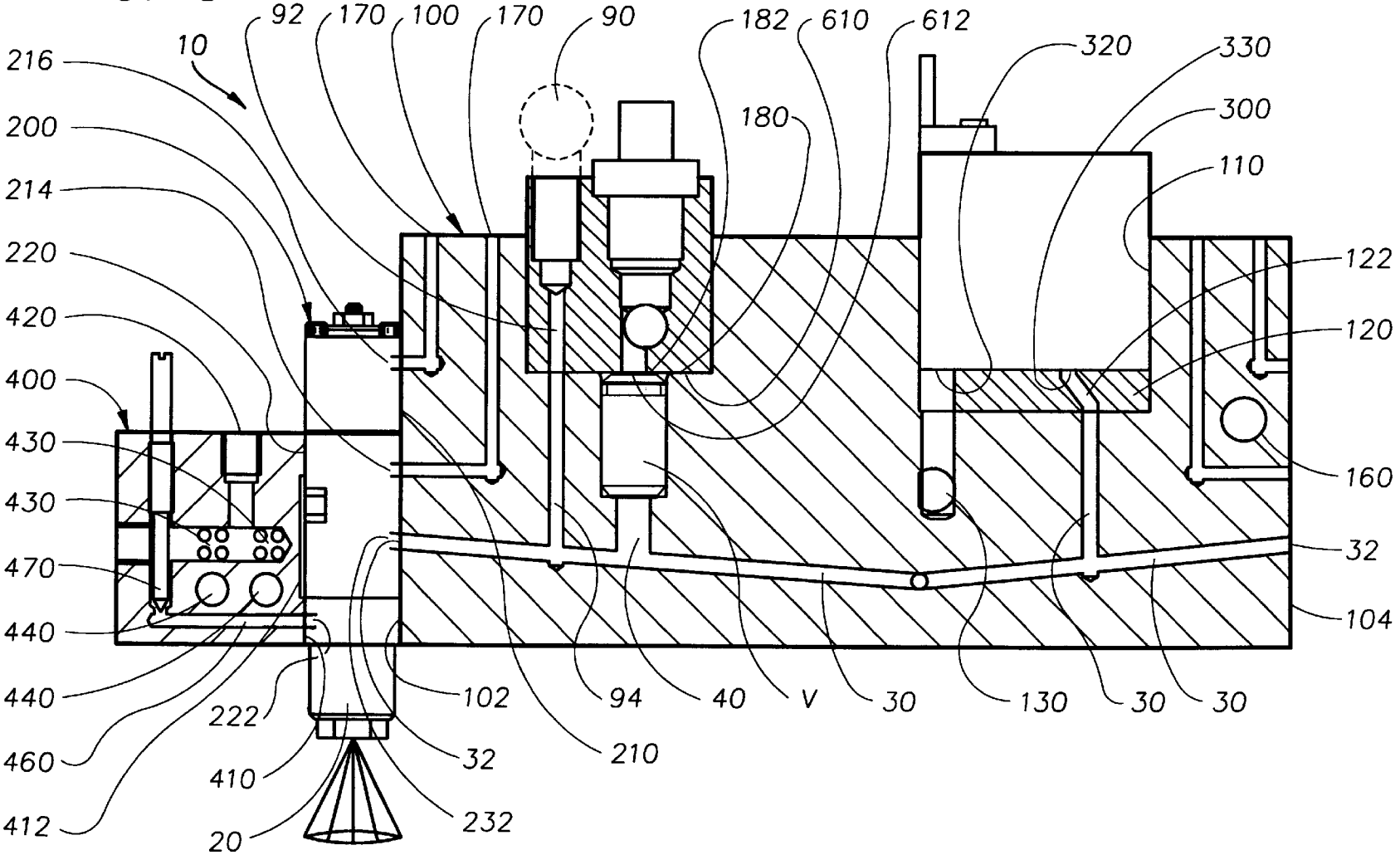
FIG. 5 is a partial sectional view, taken along lines I—I in FIG. 6, of a fluid dispensing system according to an exemplary embodiment of the invention.
Figure 6:
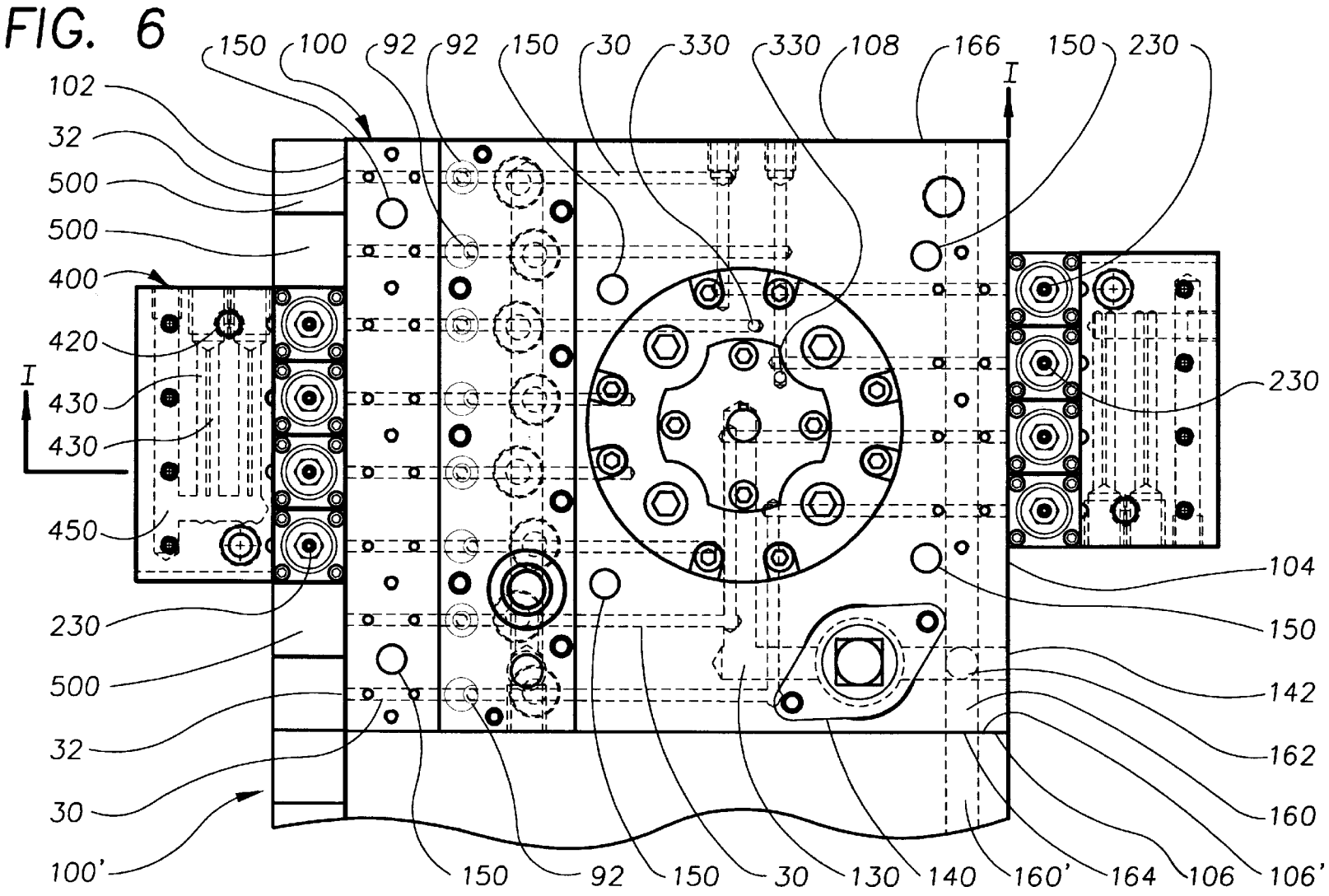
FIG. 6 is a partial top view of a hot melt adhesive dispensing system of the type shown in FIG. 5 configured according to an exemplary embodiment of the invention.

In the exemplary embodiment of FIGS. 5 and 6, the system 10 includes a main manifold 100 having a plurality of fluid supply conduits 30 coupled to a fluid metering device 300, which independently supplies fluid from a fluid reservoir, or tank, wherein the combination forms a metering gear-driven head. The main manifold 100 includes a first end portion 102 with a plurality of fluid outlet ports 32 each for coupling a corresponding fluid supply conduit 30 to a corresponding fluid dispensing nozzle 20. In an alternative embodiment, the main manifold 100 includes a second end portion 104 with a plurality of fluid outlet ports 32 for coupling a corresponding fluid supply conduit 30 to a corresponding fluid dispensing nozzle 20, wherein the fluid metering device supplies fluid to either or both end portions 102 and 104 of the main manifold 100.

In one embodiment, the fluid metering device 300 is a metering gear pump having a fluid inlet 320 coupled to the tank and a plurality of independent fluid outlets 330 each coupled to a fluid supply conduit 30 for providing precisely metered amounts of fluid to a corresponding nozzle 20. According to this embodiment, a single fluid metering device 300 independently and simultaneously supplies fluid to several fluid supply conduits 30 and nozzles 20. A pump suitable for this application is Model No. HSJ-62260-7000-0, having a fluid inlet port and eight fluid outlet ports, available from Parker Hannifin Corporation, Zenith Pumps Division, Sanford, N.C.

The main manifold 100 alternatively includes a well 110 for receiving the fluid metering device 300. An adapter plate 120 with a plurality of conduits 122 may be alternatively disposed between the fluid metering device 300 and the main manifold 100 for appropriately routing and coupling the fluid outlet ports 320 of the fluid metering device 300 with the fluid supply conduits 30. A sealing member may be disposed between the adapter plate 120 and the main manifold 100. A pump supply conduit 130 is disposed in the main manifold 100 for supplying fluid from the fluid reservoir, or tank, to the fluid metering device 300. In one embodiment, fluid is supplied from the tank to the pump fluid supply conduit 130 through a fluid filter 140 mounted in the main manifold 100. The fluid filter 140 includes a fluid inlet port 142 for coupling with the tank. A heating member disposed in the main manifold 100 heats the fluid metering device 300 and the main manifold 100 thereby providing a relatively efficient means for heating the fluid, which eliminates the requirement of a separate heating element and insulation for the fluid metering device 300. In the embodiment of FIG. 6, the heating member includes a plurality of heater cores 150 disposed in a corresponding recess in the main manifold 100. In one embodiment, one or more temperature sensors are disposed in the main manifold 100 for providing temperature data to a heating member temperature controller.

In an alternative embodiment, a second fluid supply conduit 160 having an inlet port 162 on an upper side of the main manifold 100 extends between a first port 164 on a first side 106 of the main manifold 100 and a second port 166 on a second side 108 of the main manifold. The supply conduit 160 is coupled to the pump supply conduit 130, and the inlet port 162 is coupled to the tank for supplying fluid to the fluid metering device 300. The ports 164 and 166 are coupleable to corresponding ports on one or more other main manifolds, substantially identical to the main manifold 100, mountable adjacently on the first side 106 and the second side 108 of the main manifold 100 to form an array of main manifolds. In FIG. 6, a second side 106' of a second main manifold 100', shown in part, is mounted adjacently to the first side 106 of the main manifold 100 so that the second fluid conduit 160' of the second main manifold 100' is coupled to the second fluid conduit 160 of the main manifold 100. According to this arrangement, fluid is supplied to both main manifolds by coupling the fluid reservoir, or tank, to the fluid inlet 162 of the main manifold 100. Any of unused ports 162, 164 and 166 of the conduit 160 in the array of main manifolds may be plugged. In the exemplary embodiment, all but one of the fluid inlet ports 162, and the first port 164 and second port 166 on the outermost sides of the array of main manifolds are plugged. The fluid supplied from the second fluid conduit 160 may be filtered by filter 140 in each main manifold before flowing to the inlet port 320 of the fluid metering device 300.

In the exemplary embodiment, each of the plurality of fluid dispensing nozzles 20 is part of a nozzle module 200 that is actuatable pneumatically to open and close the nozzle 20 on command. The nozzle modules 200 also have the capability to combine fluid from the fluid supply conduit 30 with compressed air for precisely controlling an amount and pattern of fluid dispensed from the nozzle 20. The nozzle module 200 includes a fluid interface 210 with a fluid inlet port 232 for coupling with a fluid supply conduit 30, and air inlet ports 214 and 216 for actuating the nozzle module 200. The nozzle module also includes an air interface 220 with an air port 222 for providing compressed air to the nozzle 20.

A nozzle module particularly suitable for this purpose is the MR-1300™ Nozzle Module, available from ITW Dynatec, Hendersonville, Tenn.

In the exemplary embodiment, the fluid interface 210 of the nozzle module 200 is mountable on either the first end portion 102 or the second end portion 104 of the main manifold 100 for coupling the fluid inlet port 232 with a corresponding fluid supply conduit 30. The main manifold 100 includes air supply conduits 170 corresponding to each fluid supply conduit 30 and coupleable to the air inlet ports 214 and 216 of each nozzle module 200. In an alternative embodiment, however, air for actuating the nozzle module 200 may be supplied to an outer side of the nozzle module 200, which eliminates the requirement for the air supply conduits 170 in the main manifold 100.

In the exemplary embodiment, the fluid metering device 300 includes eight fluid outlets 330 capable of independently supplying fluid to eight corresponding nozzles 20 through corresponding fluid supply conduits 30. The main manifold 100 of the exemplary embodiment may therefore be configured for dispensing fluid up to eight nozzles 20 at any one time by coupling nozzles 20 to corresponding fluid supply conduits 30 on either the first or second end portions 102 and 104 of the main manifold 100. A blocking member 500 is mountable over the unused fluid supply conduits 30, and in alternative embodiments the blocking member may block also the air supply conduits 170. The fluid in some blocked fluid supply conduits 30 is recirculated back toward the fluid reservoir, or tank, as further discussed below. Other embodiments may include additional fluid supply conduits 30 in the main manifold 100 and may employ a fluid metering device with more or less than eight fluid outlet ports.

FIG. 6 shows a plurality of nozzles 20 arrangeable along the first end portion 102 of the main manifold 100 wherein a spacing between adjacent nozzles 20 is substantially equal. The spacing between the nozzles 20 is based on a spacing between a central portion 230 of adjacent nozzles 20. In the exemplary embodiment, the fluid supply conduits 30 also have substantially equal spacing therebetween so that the spacing of the nozzle modules 200 is substantially equal. The spacing between the side portions 106 and 108 and the outermost fluid supply conduits 30 however is approximately one-half the spacing between adjacent fluid supply conduits 30 interior of the side portions 106 and 108. According to this configuration, the central portion 230 of the nozzles 20 coupled to the sidemost fluid supply conduits 30 is spaced similarly from the corresponding side portion 106 and 108 so that the central portions 230 of the sidemost nozzles 20 of adjacently mounted main manifolds 100 have the same spacing as the other nozzles.

FIG. 6 also shows the fluid supply conduits 30 on the second end portion 104 of the main manifold 100 offset relative to the fluid supply conduits 30 on the first end portion 102 of the main manifold 100. According to this configuration, nozzles 20 mounted on the second end portion 104 of the main manifold 100 are offset relative to nozzles 20 on the first end portion 102 of the main manifold 100. The offset spacing of the central portions 230 of the nozzles 20 disposed on opposing sides 102 and 104 of the main manifold 100 provides an interleaved fluid dispensing pattern. This offset arrangement of nozzles 20 on opposing ends of the main manifold 100 effectively forms an array of nozzles 20 with reduced spacing between the central portions 230 of adjacent nozzles compared to the nozzle spacing available by disposing nozzles on only one side of the main manifold 100. The reduced nozzle spacing is useful for some fluid dispensing applications.

An air preheater module 400 with a preheater interface 410 is mountable on the air interface 220 of a plurality of adjacently mounted nozzle modules 200, and may include a recessed portion 412 to reduce heat transfer from the air preheater module 400 to the nozzle modules 200. The air preheater module 400 includes a compressed air inlet port 420 for directing compressed air through an arrangement of parallel conduits 430 disposed over heating members 440, wherein the parallel conduits 430 have relatively increased surface area, which improves heat transfer to the air. The heated air is directed into a common plenum 450, and through a plurality of air supply conduits 460 each having an outlet port 462 coupleable to a corresponding air inlet port 222 of a corresponding nozzle module 200. An adjustable throttling valve 470 is disposed in each air supply conduit 460 for controlling heated air flow therethrough. The location of the air preheater 400 on the outer side of the nozzle module 200, apart from the main manifold 100, permits controlling the temperature of the compressed air independent from the temperature of the main manifold 100, which provides improved control of fluid dispensed from the nozzle 20.

FIGS. 5 and 6 further illustrate an alternative configuration wherein the system 10 includes a plurality of recirculation conduits 40 each interconnectable between a corresponding fluid supply conduit 30 and the fluid reservoir, or tank, by a plurality of one-way valves V each disposed along a corresponding recirculation conduit 40. The main manifold 100 includes a second interface 180 on which is mountable a recirculation manifold 600 having a recirculation interface 610. The second interface 180 of the main manifold 100 includes a plurality of recirculation outlet ports 182 for coupling the plurality of recirculation conduits 40 to a plurality of recirculation inlet ports 612 on the recirculation interface 610 of the recirculation manifold 600 as further discussed below.

In one embodiment, the plurality of one-way valves V are a plurality of one-way check valves 50 each disposed along a corresponding recirculation conduit 40 in the main manifold for recirculating fluid toward the recirculation manifold 600 when the fluid pressure in a corresponding fluid supply conduit 30 is at a first pressure threshold as discussed above. A check valve suitable for this application is Model No. 2206 available from Kepner Products, Villa Park, Ill. In the exemplary embodiment of FIG. 7*a*, the recirculation manifold includes a fluid discharge port 620 coupled to the fluid reservoir, and a normally closed pressure relief valve 60 disposed in a corresponding recess in the recirculation manifold 600. The pressure relief valve 60 opens to recirculate fluid from the recirculation conduits 40 to the discharge port 620 and toward the tank when the fluid pressure between the check valves 50 and the pressure relief valve 60 is at a second pressure threshold as discussed above. A pressure relief valve suitable for this application is Model No. CP 208-3 available from Compact Controls, Hillsboro, Oreg. In an alternative embodiment, the check valves 50 are disposed in the recirculation manifold 600. The recirculation manifold 600 also includes a pressure monitoring port 92 for receiving a pressure monitoring gauge 90, which monitors an average pressure between the check valves 50 and the pressure relief valve 60 as discussed above. The recirculation manifold 600 is interchangeably mountable on the main manifold 100 with recirculation manifolds having other configurations. A pressure transducer connectable to an indicator or alarm may alternatively be coupled to the pressure port 92 for indicating that fluid is being recirculated from one or more fluid supply conduits 30 as discussed above.

Figure 7A:
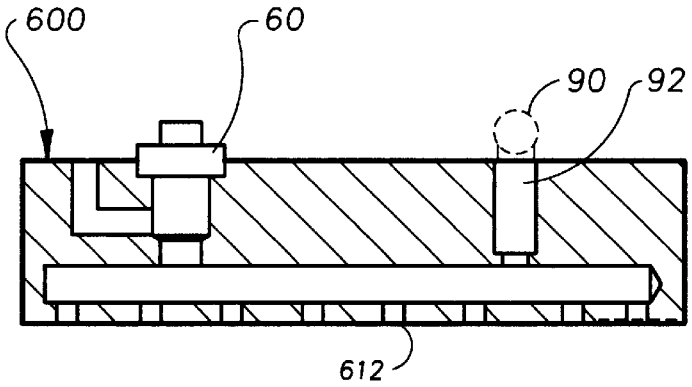
FIG. 7*a* is a partial sectional view of a recirculation manifold according to an exemplary embodiment of the invention.
Figure 7B:
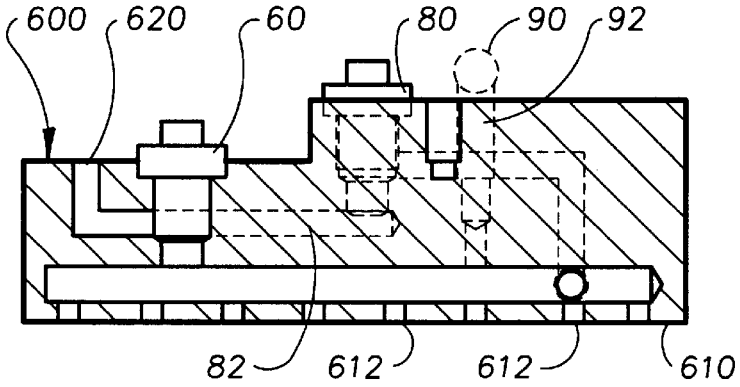
FIG. 7*b* is a partial sectional view of a recirculation manifold according to an alternative embodiment of the invention.

In the embodiment of FIG. 7*b*, a recirculation manifold 600 is configured similarly to the embodiment of FIG. 7*a*, and includes additionally a normally closed diverter valve 80 disposed in a corresponding recess in the recirculation manifold 600. The diverter valve 80 is disposed between the plurality of one-way check valves 50 and the tank in parallel to the normally closed pressure relief valve 60, and is coupled to the fluid discharge port 620 of the recirculation manifold 600 by a fluid outlet conduit 82. The diverter valve 80 facilitates relieving fluid pressure in the fluid supply conduits 30 when the pump is energized and when the plurality of nozzles 20 are closed to reduce the tendency for fluid to surge through the nozzles 20 when the nozzles are first opened as discussed above. In operation, the normally closed diverter valve 80 is opened when the nozzle modules 200 are closed, and the diverter valve is closed when the nozzle modules are opened. A diverter valve suitable for this application is Model No. CP 508-2 available from Compact Controls, Hillsboro, Oreg.

Figure 8:
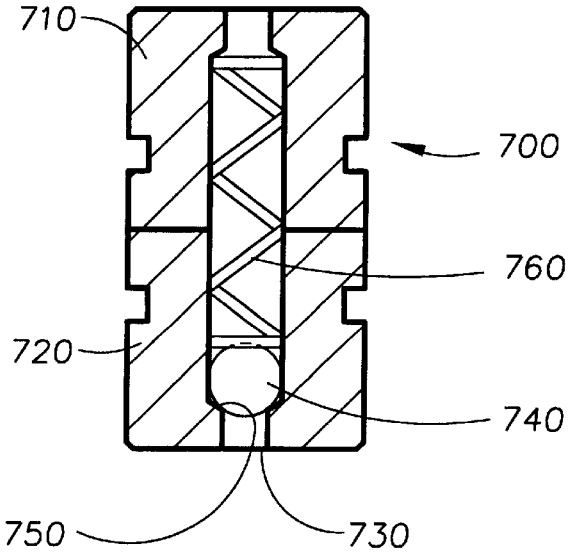
FIG. 8 is a partial sectional view of a pressure relief valve according to an exemplary embodiment of the invention.

In another embodiment, the plurality of one-way valves V are individual pressure relief valves disposed in the main manifold 100, or disposed alternatively in a recirculation manifold 600. FIG. 8 shows an pressure relief valve 700 of the type disposable in the main manifold 100 having two matable body members 710 and 720 and a central bore 730 which houses a ball 740, or other similarly seatable member, biased toward a seat 750 by a coil spring 760 wherein the threshold pressure is determined by the spring constant. The pressure relief valves 700 may be used in combination with the recirculation manifold 600 of FIG. 7*a* by replacing the pressure relief valve 60 with a plug, which is not shown.

In the embodiment of FIG. 5, the main manifold 100 includes, alternatively, a plurality of pressure monitoring ports 94 each coupled directly to a corresponding fluid supply conduit 30 for independently monitoring fluid pressure in the fluid supply conduit 30 with a corresponding pressure gauge 90. In the exemplary embodiments of FIGS. 5 and 6, the pressure monitoring ports 94 of the main manifold 100 are coupled to an array of corresponding ports 92 in the recirculation manifold 600 where corresponding pressure gauges 90 are coupled to the ports 92. The pressure gauges 90 may alternatively be disposed in the main manifold 100. The recirculation manifolds of FIGS. 7*a* and 7*b* may also alternatively be configured with individual pressure monitoring ports for coupling with the pressure monitoring ports 94 of the main manifold 100. Absent corresponding ports 92 in the recirculation manifold, the ports 94 in the main manifold 100 are blocked and are unused. A pressure transducer connectable to an indicator or alarm may alternatively be coupled to each pressure port 92 in the recirculation manifold, or directly with the ports 94 in the main manifold 100 in configurations where the ports 94 are not coupled with the recirculation manifold 100, for indicating that fluid is recirculating from a corresponding fluid supply conduit 30 as discussed above.

Figure 9A:
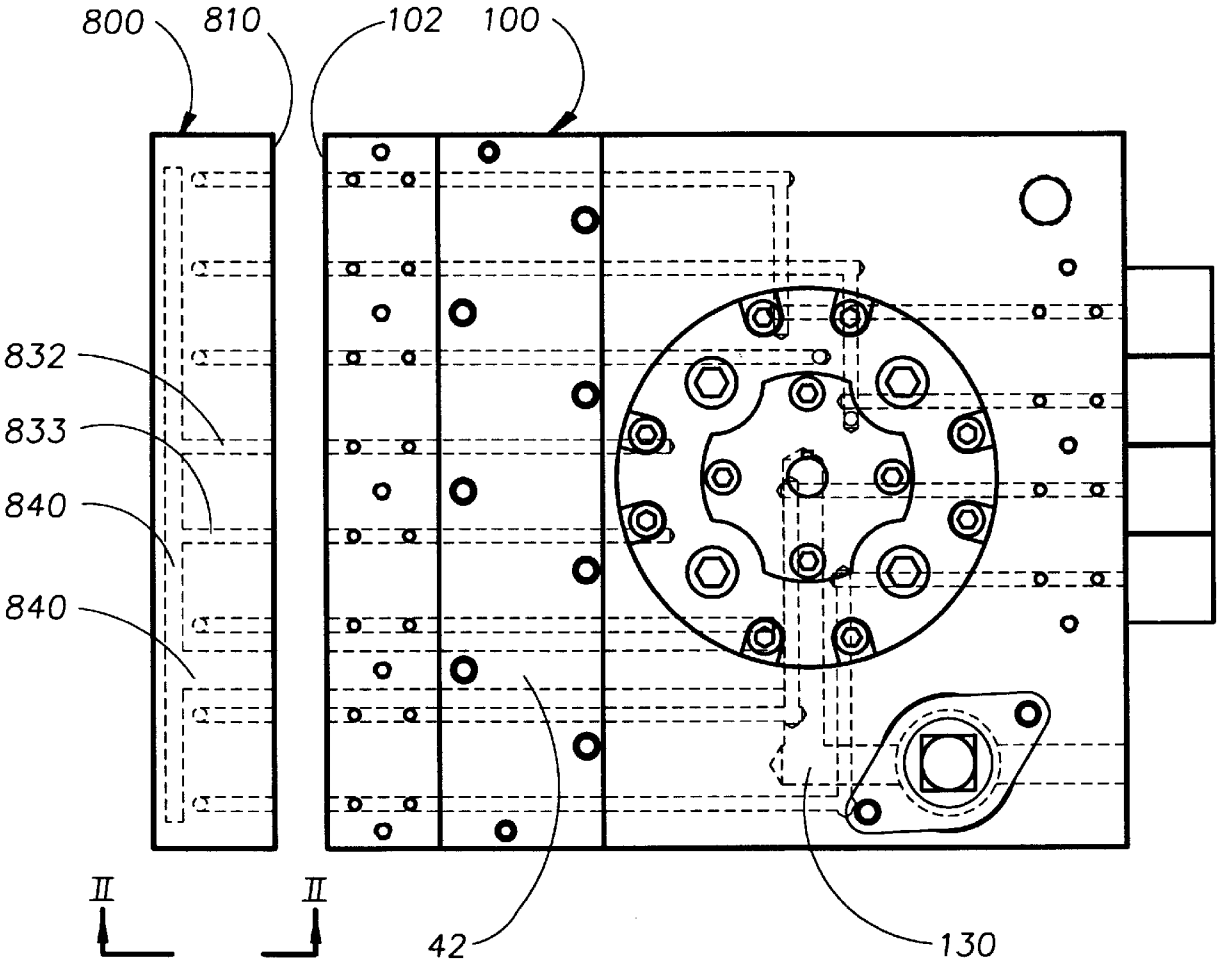
FIG. 9*a* is a partial top view of a hot melt adhesive dispensing system of the type shown in FIG. 5 configured according to another embodiment of the invention.
Figure 9B:
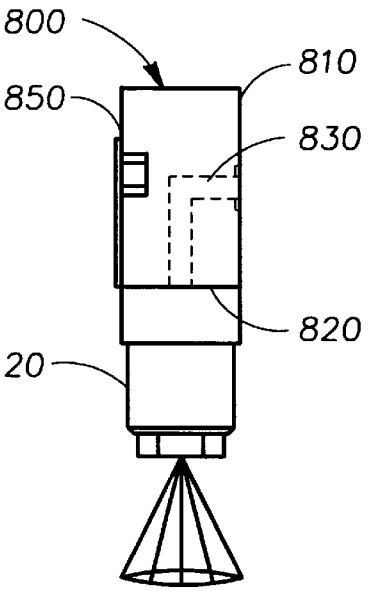
FIG. 9*b* is a partial side view taken along lines II—II of the FIG. 9*a*.

FIGS. 9*a* and 9*b* show a hot melt adhesive dispensing system of the type shown generally in FIG. 5 including a nozzle adapter plate 800 interconnecting the main manifold 100 and a plurality of nozzles 20. The nozzle adapter plate 800 includes a fluid interface 810 connectable to the first end 102 of the main manifold 100 and a nozzle interface 820 connectable to one or more nozzles 20. The nozzle adapter plate 800 includes a plurality of fluid supply conduits 830 interconnecting a corresponding fluid supply conduit 30 of the main manifold 100 and a corresponding nozzle 20 mountable on the nozzle adapter plate interface 820. In another configuration, the nozzle adapter plate 800 includes an air interface 850 with air supply ports for interconnecting the nozzles 20 and an air preheater module 400, which supplies compressed air for modifying fluid flow through the nozzles 20 as discussed above.

According to another aspect of the invention, the nozzle adapter plate 800 includes a recirculation conduit 840 for recirculating fluid from one or more fluid supply conduits 30 toward the reservoir. In one configuration, the recirculation conduit 840 is coupled to a recirculation conduit 42 in the main manifold 100 for recirculating fluid from the unused fluid supply conduit 830 to the fluid supply conduit 130 in the main manifold 100. Generally, each fluid supply conduit 830 is selectably connectable to the recirculation conduit 840 by a valve or removable plug for recirculating fluid in the event that a corresponding nozzle is closed or a nozzle is replaced by a blocking member 500 as discussed above. According to this configuration, fluid from any blocked fluid supply conduit 830 is recirculated through the recirculation conduit 840 toward the reservoir by opening the valve or removing the plug to couple the fluid supply conduit 830 to the recirculation conduit 840. According to another configuration, the recirculation conduit 840 is coupled only to one or more unused or blocked off fluid supply conduits 832 and 833, which is desired for some fluid dispensing applications.

While the foregoing written description of the invention enables anyone skilled in the art to make and use what is at present considered to be the best mode of the invention, it will be appreciated and understood by those skilled in the art the existence of variations, combinations, modifications and equivalents within the spirit and scope of the specific exemplary embodiments disclosed herein. The present invention therefore is to be limited not by the specific exemplary embodiments disclosed herein but by all embodiments within the scope of the appended claims.

What is claimed is:

1. A system usable for dispensing fluids including hot melt adhesives, supplied from a reservoir, onto a substrate, the system comprising:

a plurality of fluid dispensing nozzles;

a fluid metering device having a plurality of metered fluid outlets for supplying fluid from the reservoir;

a plurality of fluid supply conduits, each fluid supply conduit interconnectable between a metered fluid outlet of the fluid metering device and a corresponding fluid dispensing nozzle;

a plurality of fluid recirculation conduits, each fluid recirculation conduit interconnectable between a corresponding fluid supply conduit and one of the reservoir and fluid metering device; and a plurality of one-way pressure relief valves, each pressure relief valve disposed between a corresponding fluid supply conduit and one of the reservoir and fluid metering device, each pressure relief valve independently recirculates fluid from the corresponding fluid supply conduit to a corresponding fluid recirculation conduit when pressure in the corresponding fluid supply conduit exceeds a threshold pressure, whereby fluid is recirculated toward one of the reservoir and the fluid metering device.

2. The system of claim 1 further comprising:

a main manifold having a first end portion with a plurality of fluid outlet ports each coupleable to a fluid dispensing nozzle, a second interface with a plurality of recirculation outlet ports, the plurality of fluid supply conduits disposed at least partially in the main manifold between the fluid metering device and a corresponding fluid outlet port a recirculation manifold having a plurality of recirculation inlet ports on a recirculation interface mountable on the second interface of the main manifold, each of the plurality of recirculation inlet ports of the recirculation manifold is coupleable to a corresponding recirculation outlet port of the main manifold, the plurality of fluid recirculation conduits disposed at least partially in the recirculation manifold, the plurality of pressure relief valves disposed along a corresponding fluid recirculation conduit in one of the main manifold and the recirculation manifold.

3. The system of claim 2 further comprising a nozzle adapter plate interconnecting the main manifold and the plurality of fluid dispensing nozzles, the nozzle adapter plate having a second recirculation conduit interconnectable with one or more fluid supply conduits of the main manifold and one of the reservoir and the fluid metering device for recirculating fluid from the one or more fluid supply conduits.

4. The system of claim 1 further comprising a plurality of air supply conduits, each air supply conduit interconnectable between an air supply and a corresponding fluid dispensing nozzle for modifying the dispensing of fluid from the fluid dispensing nozzle.

5. The system of claim 1 further comprising a plurality of pressure monitoring ports, each pressure monitoring port connectable with a corresponding fluid supply conduit for independently monitoring pressure in the corresponding fluid supply conduit.

6. The system of claim 2 further comprising a plurality of nozzle modules, each nozzle module corresponding to one of the plurality of fluid dispensing nozzles, and each nozzle module having a fluid inlet port on a fluid interface mountable on the first end portion of the main manifold, wherein the fluid inlet port of the nozzle module is coupled to a corresponding fluid outlet port of the main manifold.

7. The system of claim 2 wherein the recirculation manifold includes a plurality of pressure monitoring ports, each pressure monitoring port coupled to a corresponding fluid supply conduit for independently monitoring pressure in the corresponding fluid supply conduit.

8. The system of claim 2 wherein the main manifold includes a second end portion with a plurality of fluid outlet ports each coupleable to a fluid dispensing nozzle, the plurality of fluid supply conduits disposed at least partially in the main manifold between the fluid metering device and a corresponding fluid outlet port on the second end portion, the second end portion on an opposing end of the main manifold as the first end portion, wherein fluid dispensing nozzles coupled to the second end portion of the main manifold are offset relative to fluid dispensing nozzles coupled to the first end portion of the main manifold.

9. The system of claim 2 further comprising an air preheater module having a plurality of air outlet ports on a preheater interface, the plurality of fluid dispensing nozzles each have an air inlet port connectable with a corresponding air outlet port of the air preheater module for modifying the dispensing of fluid from the corresponding fluid dispensing nozzle.

10. A system useable for dispensing fluids including hot melt adhesives, supplied from a reservoir, onto a substrate, the system comprising:

a plurality of fluid dispensing nozzles;

a fluid metering device having a plurality of metered fluid outlets for supplying fluid from the reservoir;

a plurality of fluid supply conduits, each fluid supply conduit interconnectable between a metered fluid outlet of the fluid metering device and a corresponding fluid dispensing nozzle;

a plurality of fluid recirculation conduits, each fluid recirculation conduit interconnectable between a corresponding fluid supply conduit and one of the reservoir and fluid metering device;

a plurality of one-way check valves, each one-way check valve disposed between a corresponding fluid supply conduit and one of the reservoir and fluid metering device, each one-way check valve independently recirculates fluid from the corresponding fluid supply conduit to a corresponding fluid recirculation conduit when pressure in the corresponding fluid supply conduit exceeds a first threshold pressure;

at least one pressure relief valve disposed between the plurality of one-way check valves and one of the reservoir and fluid metering device.

11. The system of claim 10 further comprising a diverter valve disposed between the plurality of one-way check valves and one of the reservoir and fluid metering device, the diverter valve disposed parallel to the pressure relief valve.

12. The system of claim 10 further comprising:

a main manifold having a first end portion with a plurality of fluid outlet ports each coupleable to a fluid dispensing nozzle, a second interface with a plurality of recirculation outlet ports, the plurality of fluid supply conduits disposed at least partially in the main manifold between the fluid metering device and a corresponding fluid outlet port; and a recirculation manifold having a plurality of recirculation inlet ports on a recirculation interface mountable on the second interface of the main manifold, each of the plurality of recirculation inlet ports of the recirculation manifold is coupleable to a corresponding recirculation outlet port of the main manifold, the plurality of fluid recirculation conduits disposed at least partially in the recirculation manifold, the at least one pressure relief valve disposed in the recirculation manifold, and the plurality of one-way check valves disposed along a corresponding fluid recirculation conduit in one of the main manifold and the recirculation manifold.

13. The system of claim 10 further comprising the plurality of one-way check valves open at a first threshold pressure, and the pressure relief valve opens at a second threshold pressure greater than the first threshold pressure, the pressure relief valve recirculates fluid from the plurality of one-way check valves toward one of the reservoir and fluid metering device when pressure between the plurality of one-way check valves and the pressure relief valve exceeds the second threshold pressure, whereby fluid is recirculated toward one of the reservoir and the fluid metering device.

14. The system of claim 10 further comprising the plurality of one-way check valves open at a first threshold pressure, and the pressure relief valve opens at a second threshold pressure, the pressure relief valve recirculates fluid from the plurality of one-way check valves toward one of the reservoir and fluid metering device when pressure between the plurality of one-way check valves and the pressure relief valve exceeds the second threshold pressure, whereby fluid is recirculated toward one of the reservoir and the fluid metering device.

15. The system of claim 10 further comprising a plurality of air supply conduits, each air supply conduit interconnectable between an air supply and a corresponding fluid dispensing nozzle for modifying the dispensing of fluid from the fluid dispensing nozzle.

16. The system of claim 10 further comprising a pressure port for monitoring an average pressure in the recirculation conduits between the plurality of check valves and the pressure relief valve.

17. The system of claim 12 further comprising a pressure port in the recirculation manifold for monitoring an average pressure in the recirculation conduits between the plurality of check valves and the pressure relief valve.

18. The system of claim 12 further comprising a plurality of pressure monitoring ports, each pressure monitoring port corresponding with a fluid supply conduit for independently monitoring pressure in the corresponding fluid supply conduit.

19. The system of claim 12 further comprising a diverter valve disposed in the recirculation manifold between the plurality of one-way check valves and one of the reservoir and fluid metering device, the diverter valve disposed parallel to the pressure relief valve.

20. The system of claim 10 further comprising a plurality of pressure monitoring ports, each pressure monitoring port connectable with a corresponding fluid supply conduit for independently monitoring pressure in the corresponding fluid supply conduit.

21. A system usable for dispensing fluids including hot melt adhesives, supplied from a reservoir, onto a substrate, the system comprising:

a plurality of fluid dispensing nozzles;

a fluid metering device having a plurality of metered fluid outlets for supplying fluid from the reservoir;

a main manifold having a well for receiving the fluid metering device and a plurality of fluid supply conduits disposed in the main manifold between a corresponding fluid outlet of the fluid metering device and a corresponding fluid outlet port of the main manifold coupleable to a corresponding fluid dispensing nozzle; and a heating member disposed in the main manifold for heating the main manifold and the fluid metering device.

22. The system of claim 21, wherein the heating member includes a plurality of heater cores each disposed in a corresponding recess in the main manifold.

23. A system usable for dispensing fluids including hot melt adhesives, supplied from a reservoir by a fluid metering device, onto a substrate, the system comprising:

a plurality of fluid dispensing nozzles;

a plurality of adjacently mounted main manifolds including at least a first main manifold and a second main manifold, each main manifold having first and second side portions, each main manifold having at least a first end portion, and each main manifold having a plurality of fluid supply conduits each coupleable to a corresponding fluid dispensing nozzle, the plurality of adjacently mounted main manifolds are mounted so that a first side portion of the first main manifold is adjacent the second side portion of the second main manifold, the plurality of fluid dispensing nozzles are coupleable to the plurality of fluid supply conduits along the first end portions of the plurality of adjacently mounted main manifolds, and the plurality of fluid dispensing nozzles are arrangeable along the first end portions of the plurality of adjacently mounted main manifolds with substantially equal spacing between adjacent fluid dispensing nozzles.

24. The system of claim 23 further comprising a fluid metering device associated with each of the plurality of adjacently mounted main manifolds, each fluid metering device mounted in a well disposed in the associated main manifold, and a heating member disposed in each main manifold for heating the main manifold and the fluid metering device.

25. The system of claim 23, wherein at least first and second sidemost fluid dispensing nozzles are arrangeable along the first end portion of each of the adjacently mounted main manifolds nearest the first and second side portions, and a spacing between each of the first and second side portions and corresponding sidemost fluid dispensing nozzles is approximately one half the spacing between adjacent fluid dispensing nozzles.

26. The system of claim 23 wherein each of the plurality of adjacently mounted main manifolds includes a second fluid supply conduit extending between the first and second side portions, wherein the second fluid supply conduit of each of the main manifolds is coupleable to the second fluid supply conduit of an adjacently mounted main manifold.

27. A system usable for dispensing fluids including hot melt adhesives, supplied from a reservoir by a fluid metering device, onto a substrate, the system comprising:

a plurality of fluid dispensing nozzles;

a main manifold having a plurality of fluid supply conduits, each fluid supply conduit coupleable between the fluid metering device and a corresponding fluid dispensing nozzle, the main manifold having a fluid recirculation conduit disposed between each fluid supply conduit and a corresponding recirculation outlet port disposed on a second interface of the main manifold; and a recirculation module for recirculating fluid from the main manifold to one of the reservoir and the fluid metering device, the recirculation module selected from a group consisting essentially of:

a first recirculation module having a plurality of fluid inlet ports disposed on a recirculation interface of the first recirculation module interchangeably mountable on the second interface of the main manifold wherein fluid inlet ports of the first recirculation module are coupleable with corresponding recirculation outlet ports of the main manifold, a plurality of one-way pressure relief valves disposed along a corresponding fluid recirculation conduit in one of the main manifold and the first recirculation module;

a second recirculation module having a plurality of fluid inlet ports disposed on a recirculation interface of the second recirculation module interchangeably mountable on the second interface of the main manifold wherein fluid inlet ports of the second recirculation module are coupleable with corresponding recirculation outlet ports of the main manifold, a pressure relief valve disposed in the second recirculation module, a plurality of one-way check valves disposed along a corresponding fluid recirculation conduit in one of the main manifold and the second recirculation module, the pressure relief valve disposed between the plurality of one-way check valves and one of the reservoir and fluid metering device; and a third recirculation module having a plurality of fluid inlet ports disposed on a recirculation interface of the third recirculation module interchangeably mountable on the second interface of the main manifold wherein fluid inlet ports of the third recirculation module are coupleable with corresponding recirculation outlet ports of the main manifold, a pressure relief valve and a diverter valve disposed in the third recirculation module, a plurality of one-way check valves disposed along a corresponding fluid recirculation conduit in one of the main manifold and the third recirculation module, the pressure relief valve and diverter valve disposed in parallel between the plurality of one-way check valves and one of the reservoir and the fluid metering device.

28. The system of claim 27 wherein the main manifold includes a plurality of pressure monitoring ports in the second interface for independently monitoring pressure in the corresponding fluid supply conduit, the recirculation module including a plurality of pressure monitoring ports coupleable with a corresponding pressure monitoring port of the main manifold when the recirculation module is interchangeably mounted on the second interface of the main manifold.

* * * * *